US006192728B1

(12) United States Patent
Hu

(10) Patent No.: US 6,192,728 B1
(45) Date of Patent: Feb. 27, 2001

(54) PIPE BENDING MACHINE ACCURATELY CONTROLLING BENT ANGLES OF PIPES

(75) Inventor: Ping-Kun Hu, Tainan (TW)

(73) Assignee: Yin Lin Machine Industrial Co., LTD, Tainan (TW)

( * ) Notice: Subject to any disclaimer, the term of this patent is extended or adjusted under 35 U.S.C. 154(b) by 0 days.

(21) Appl. No.: 09/580,850

(22) Filed: May 30, 2000

(51) Int. Cl.[7] ..... B21D 7/04; B21D 9/05
(52) U.S. Cl. ..... 72/149
(58) Field of Search ..... 72/149, 155, 156, 72/159, 367.1, 369

(56) References Cited

U.S. PATENT DOCUMENTS 4,563,891 * 1/1986 Schwarze ..... 72/149
4,750,346 * 6/1988 Traub ..... 72/149
5,148,695 * 9/1992 Ellis ..... 72/158
5,678,411 * 10/1997 Schwarze ..... 72/149

* cited by examiner

*Primary Examiner*—Rodney A. Butler
(74) *Attorney, Agent, or Firm*—Alan Kamrath

(57) ABSTRACT

A pipe bending machine accurately controlling bent angle of material pipes includes a base, a material feeding device fixed on the base, an arm-turning shaft fixed in front of the base, a bending mold fixed on the arm-turning shaft, a turning arm rotated by a transmitting device. The turning arm has a clamp mold fixed thereon for clamping a material pipe with help of the bending mold. The transmitting device includes a threaded rod rotated by a motor, a threaded nut screwing with the threaded rod and connected with a pull block, and an interactive device positioned between the pull block and arm-turning shaft. Rotation force of the motor is converted into straight pushing force by means of the threaded rod and the threaded nut. At this time, counter pressure of the ball threaded rod can easily reach zero, so even if a speed reducer of high counter-pressure is provided, the threaded rod can reduce largely the counter-pressure of the speed reducer because of the counter-pressure produced before the threaded rod changes speed. Then the pipe bending machine can accurately bends pipes with high speed.

4 Claims, 8 Drawing Sheets

PIPE BENDING MACHINE ACCURATELY CONTROLLING BENT ANGLES OF PIPES

BACKGROUND OF THE INVENTION

This invention relates to a pipe ending machine, particularly controlling accurately bending action with high speed by means of a ball threaded rod and a ball threaded nut.

Conventional pipe bending machines uses air or oil pressure cylinders or motors as power source for bending straight pipes into preset angles. Air pressure cylinders have a drawback of leak in use, and oil pressure cylinders may easily leak oil and have oil temperature problems. In general, air or oil pressure cylinders used as power source involves bad stability in bending process, so motors are preferable for pipe bending machines. However, pipe-bending machines using motors as power source still may be influenced by counter-pressure of the component such as a speed reducer, causing accuracy hard to ensure.

A pipe-bending machine disclosed in U.S. Pat. No. 4,750,346 is shown in FIGS. 1 and 2, bending a pipe 10 to form a bent portion 101, including a base 11 laid on the ground, a material feeding device 12 fixed on the base 11 for moving a pipe 10. The feeding device 12 has a clamp head 13 in the front portion, a bending device 14 fixed at the most front (in the left side in FIG. 1) to form a bent portion 101. The bending device 14 has an arm-turning shaft 141 for the pipe 10 to rest on, and a turning arm 142 to hold the pipe 10. A clamp mold 143 to clamp the pipe 10 is fixed on the turning arm 142, which is moved by a transmitting device 2 deposited in a lower portion of the base 10.

As shown in FIGS. 2 and 3, the above patent has the transmitting device including a speed reducer 21 fixed in a lower portion of the base 11 and a motor 22 under the speed reducer 21 to move together. The speed reducer 21 has an output shaft 211 protruding up an upper side and in parallel with the axis of the arm-turning shaft 141. A disc 212 is fixed on the output shaft 211 to move together, and two cranks 23 are connected between the disc 212 and the turning arm 142. When the motor 22 drives the speed reducer 21, the output shaft 211 transmits power to turn the disc 212, and then the cranks 23 to force the turning arm 142 rotate with the arm-turning shaft 141 as a pivot. Then the pipe 10 clamped between the clamp mold 143 and the arm-turning shaft 141 is bent to form the bent portion 101.

The conventional pipe-bending machine 1 utilizes the motor 22 and the speed reducer 21 to directly move the two cranks 23, and then rotates the turning arm 142 to achieve the objective to bend a pipe. But a common speed reducer 21 may produce counter-pressure problem owing to accuracy of a component in the process of operation. In order to enhance accuracy of high speed bending, a low counter-pressure (or good process accuracy) speed reducer may be chosen, but this kind of speed reducer must have its gears to be coordinated with cutting, grinding, hardening, choosing and assembly. Manufacturing may cost very high, and take much time. If a speed reducer 21 of common counter-pressure is used in a pipe bending machine, error in counter-pressure is directly transmitted by the two cranks 23 to the turning arm 142, letting the arm-turning shaft 141 also have the same counter-pressure to cause inaccuracy in pipe bending action with high speed. Besides, the two cranks 23 are designed to interact with each other, the speed reducer and the motor 22 have to positioned vertical, so the height of the base 11 has to be increased, with the dimensions of the pipe bending machine difficult to reduce.

SUMMARY OF THE INVENTION

This invention has been devised to offer a pipe-bending machine accurately controlling accuracy of bent angles of pipes.

The invention includes a base, a material feeding device, an arm fixing device, a pipe bending device, and a transmission device.

The base has a flat wall along below the moving route of a material pipe, and the flat wall has a side, from which a vertical extension wall extends down, with an opening bored in the vertical extension wall.

The material feeding device is fixed on the base for clamping and moving a material pipe.

The arm-fixing device is fixed on the base to hold a material pipe.

The pipe-bending device is positioned in front of the flat surface of the base, including a vertical arm-turning shaft fixed on the flat wall, which has a bending mold for a material pipe to rest on, connected and move with a turning arm. The turning arm has a clamp mold facing the bending mold to clamp a material pipe.

The transmitting device is fixed between the flat wall and the vertical side wall of the flat wall, for driving the turning arm to rotate, having a motor fixed on the vertical side wall, and a ball threaded rod driven by the motor and located in parallel to the pipe moving route. The threaded rod is positioned between two bearing bases vertically protruding up the vertical sidewall, screwed with a threaded nut facing the opening on the base. The ball threaded nut moves together with a pull block, which is moved by an interacting device positioned between itself and the arm-turning shaft.

When the motor drives the ball threaded rod rotate, the ball threaded rod may move the pull block, and then the interactive device rotates the arm-turning shaft, so the turning arm may rotate with the arm-turning shaft as a pivot, performing bending action to the material pipe clamped between the clamp mold and the bending mold.

BRIEF DESCRIPTION OF DRAWINGS

This invention will be better understood be referring to the accompanying drawings, wherein.

DETAILED DESCRIPTION OF THE PREFERRED EMBODIMENT

Figure 1:
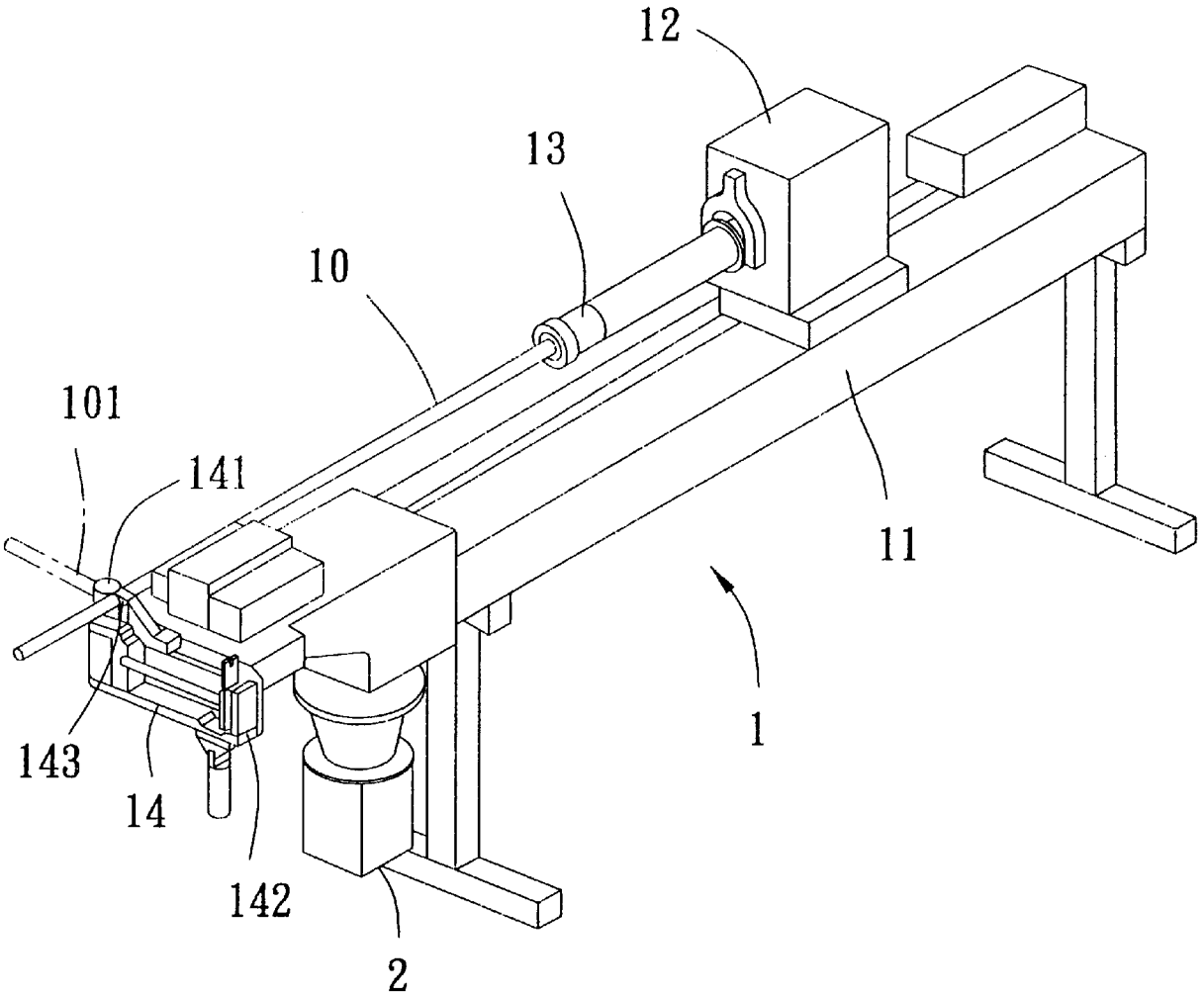
FIG. 1 is a perspective view of a pipe-bending machine of U.S. Pat. No. 4,750,346.
Figure 2:
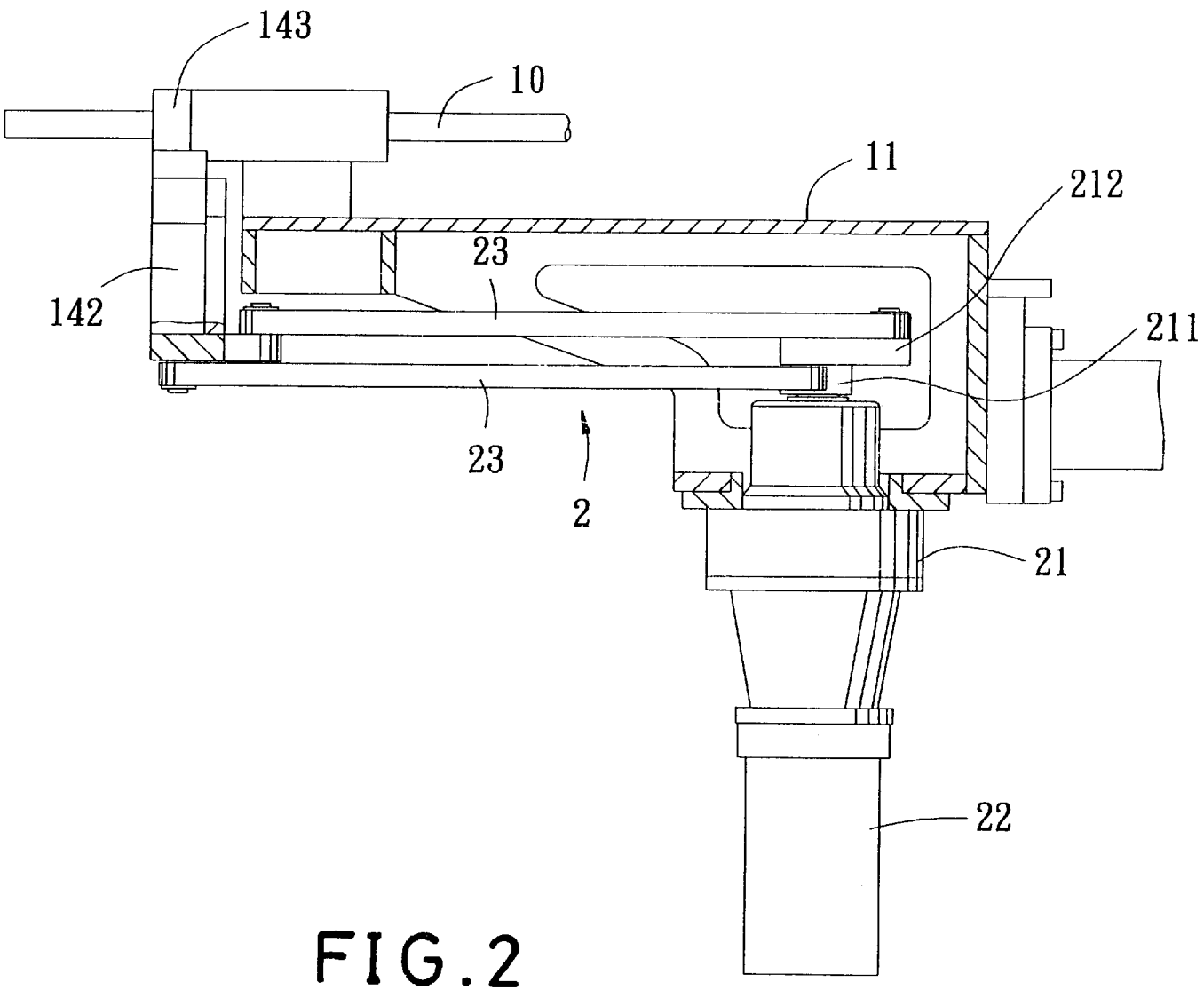
FIG. 2 is a side view of a transmitting device of U.S. Pat. No. 4,750,346.
Figure 3:
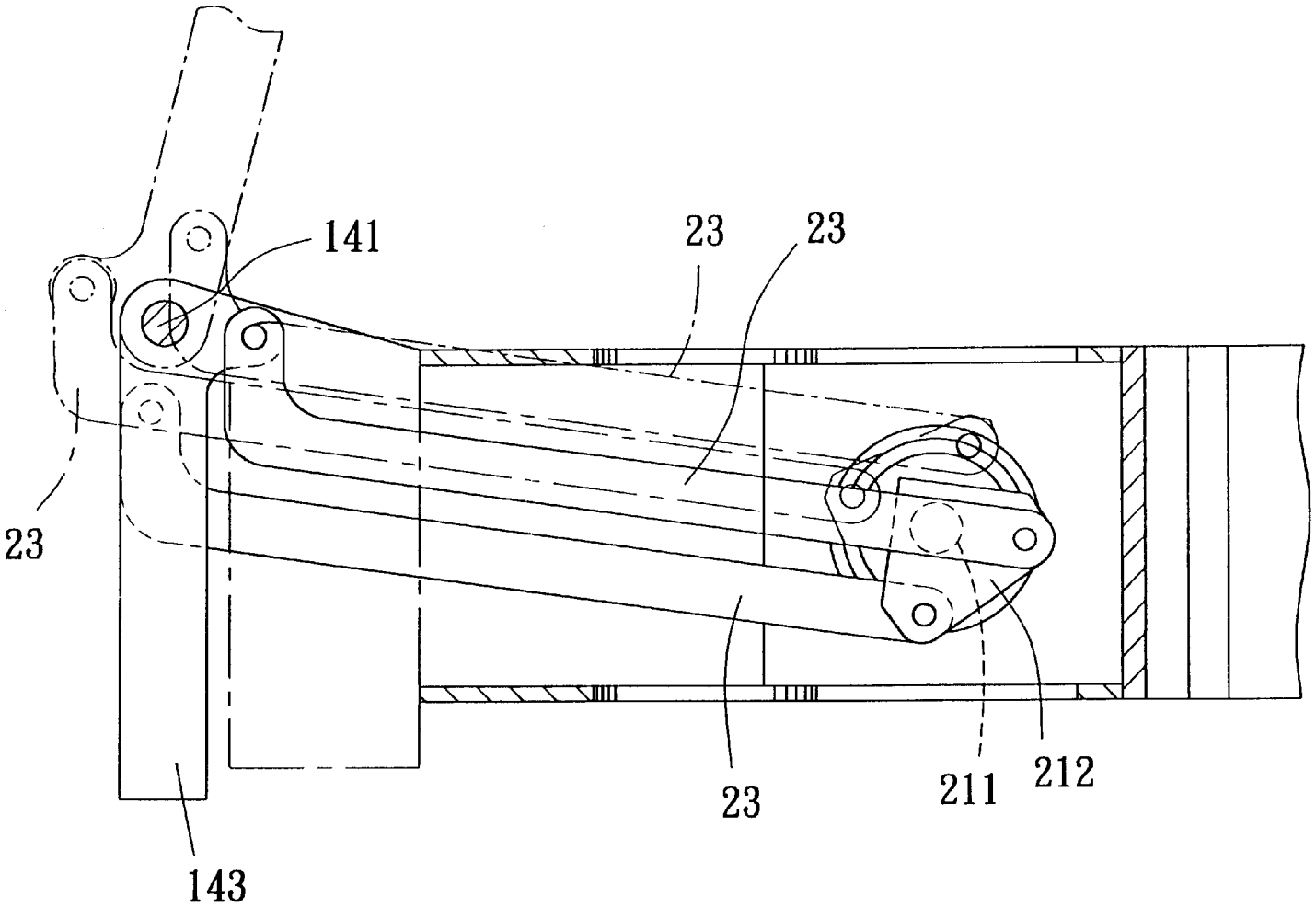
FIG. 3 is an upper view of the transmitting device of U.S. Pat. No. 4,750,346.
Figure 4:
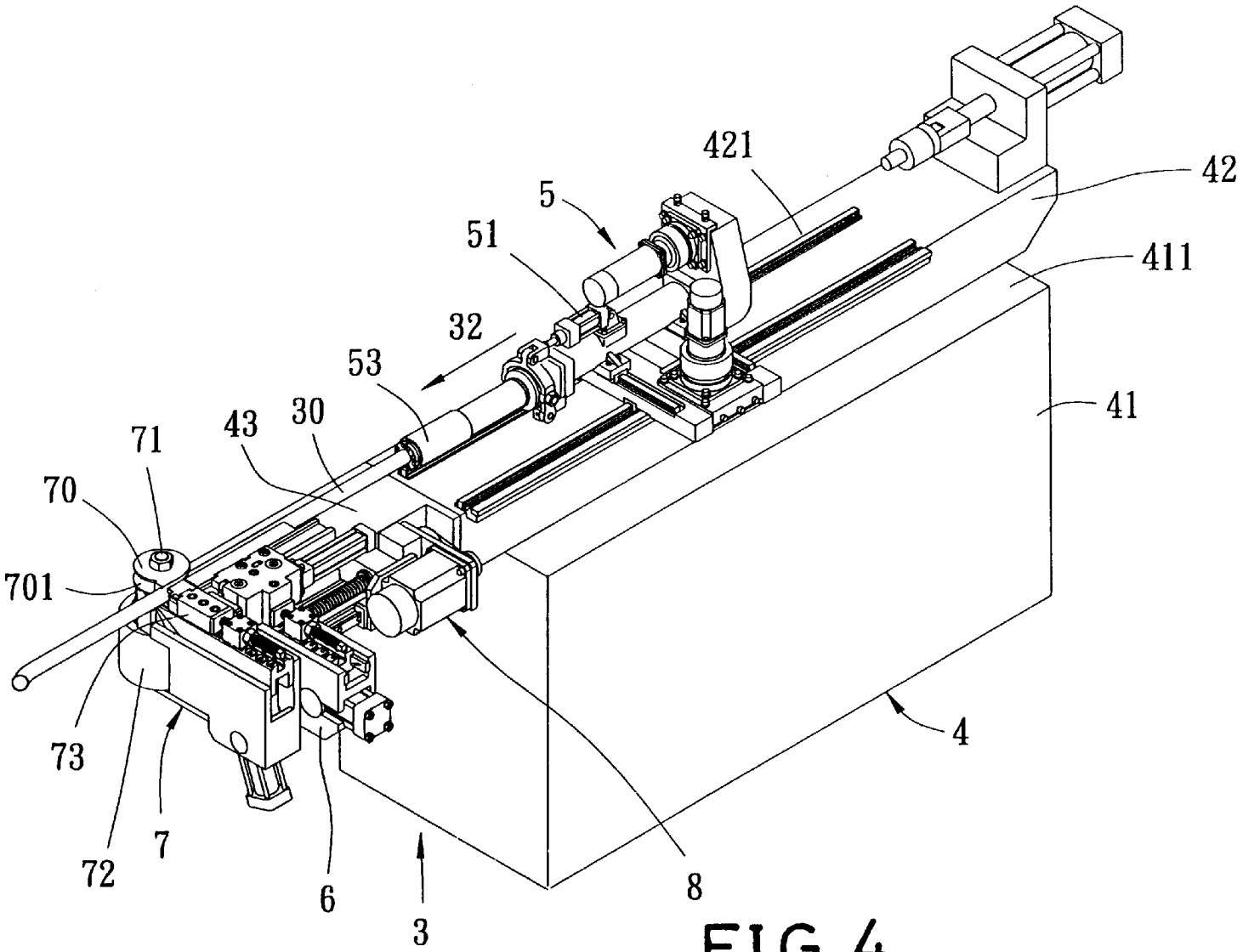
FIG. 4 is a perspective view of a preferred embodiment of a pipe-bending machine in the present invention.
Figure 5:
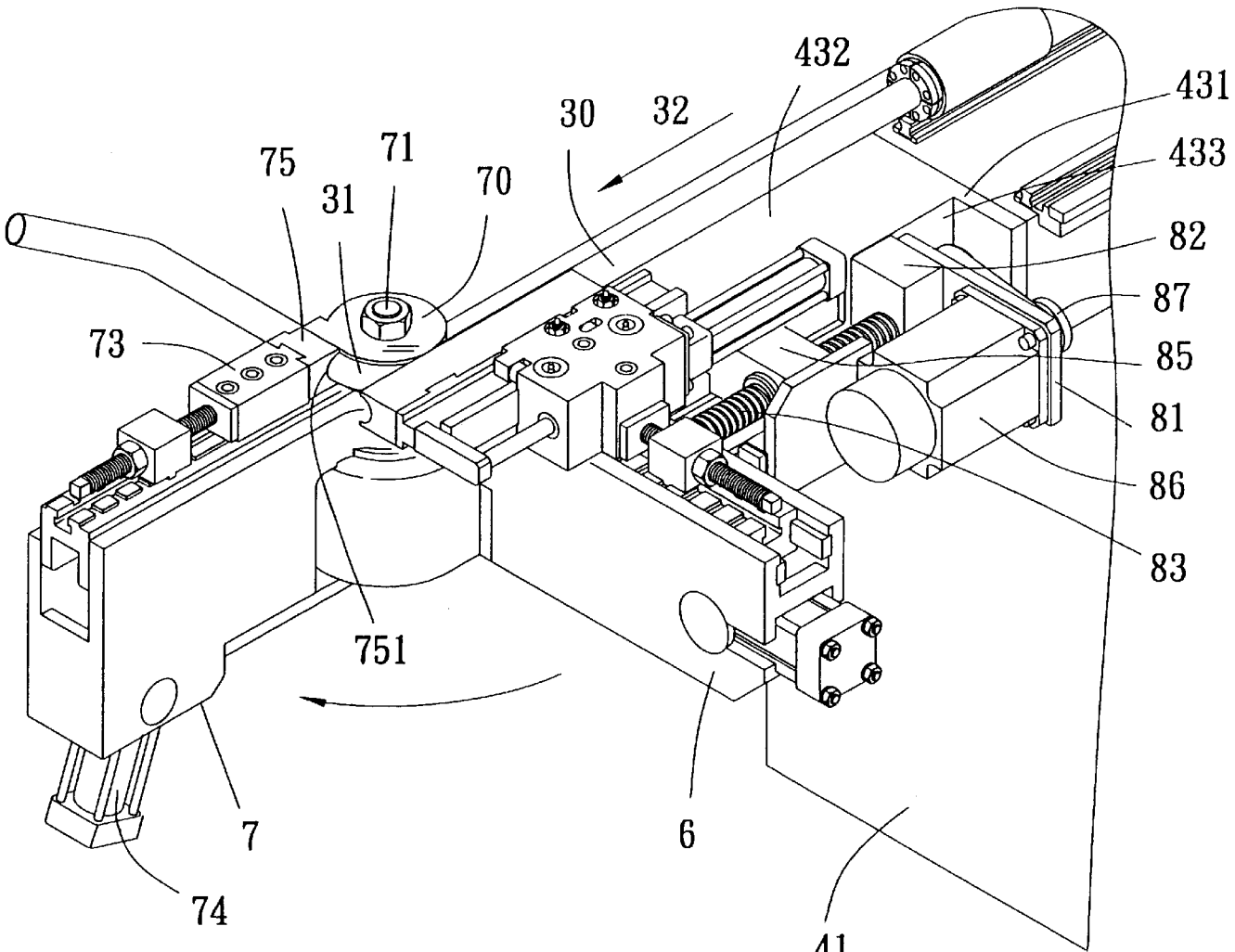
FIG. 5 is a partial perspective view of a bending device under bending action of a material pipe in the present invention.

A preferred embodiment of a pipe bending machine in the present invention, as shown in FIGS. 4 and 5, can bend a material pipe 30 to form a bent portion 31, with the material pipe moving along a process route 32, including a base 4, a material feeding device 5, an arm fixing device 6, a bending device 7 and a transmitting device as main components. The front and rear direction in the description is based on the material pipe-processing route 32. For example, the left side in FIG. 4 is the front side and the right side in FIG. 4 is the rear side.

Figure 6:
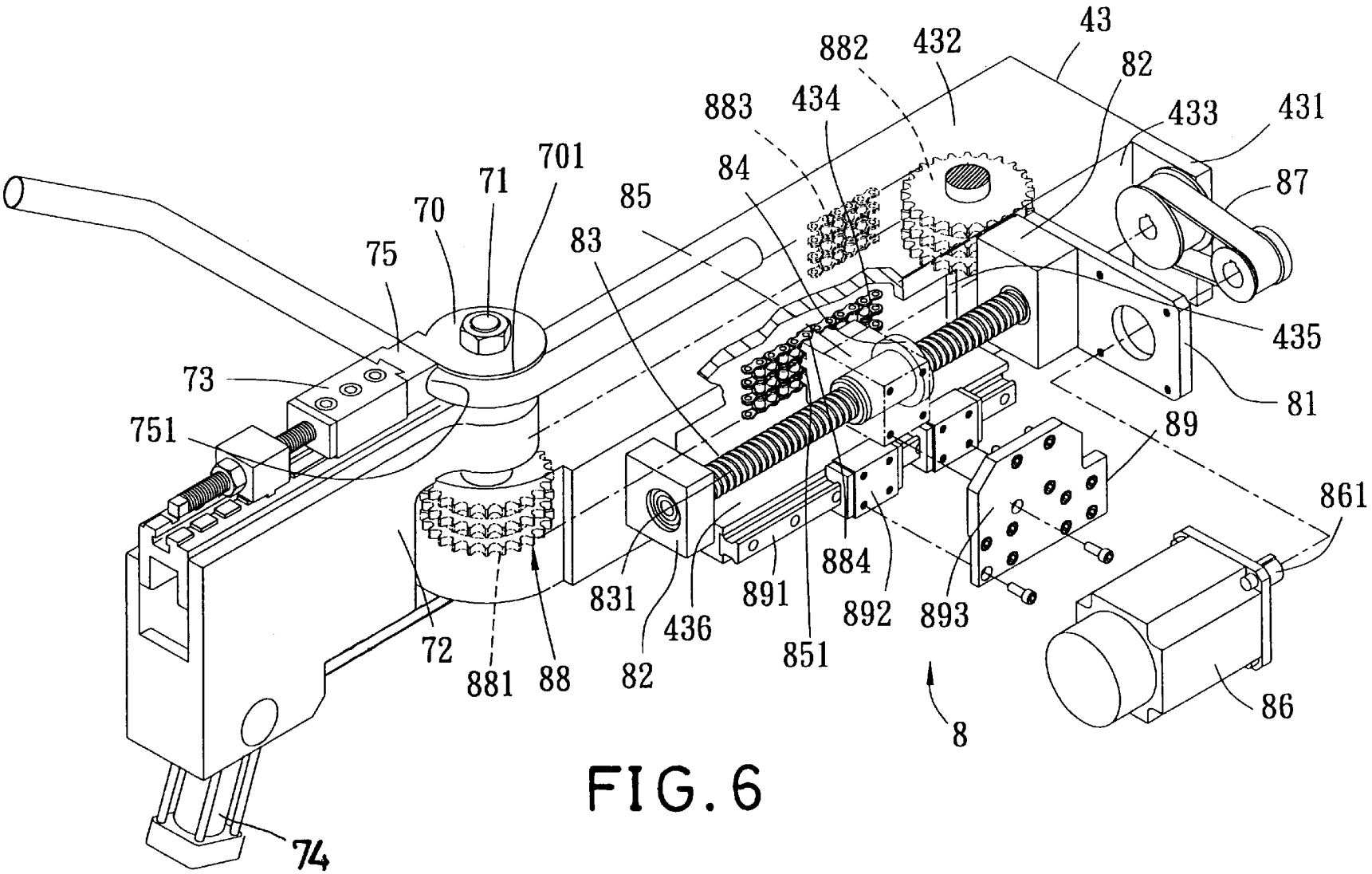
FIG. 6 is a perspective view of a relative position of a transmitting device and the bending device in the present invention.

The base 4 as shown in FIGS. 5 and 6, has a main rectangular table 41, a flat surface 411 formed on the upper side of the main table 41, a rail base 42 fixed on the flat surface 411 and provided with two rails 421 in parallel to the material processing route 32 of the material pipe 30, and an extension table 43 formed in front of the rails 421 and having a bottom pending in air. The extension table 43 has a vertical wall 421 resting against the front wall of said rail base 42, a flat wall 432 extending forward from an upper end, a vertical side wall 433 extending down from an inner side of the flat wall 432, a chain wheel room 434 formed between the flat wall 432 and the vertical side wall 433, an opening 435 formed in the vertical side wall 433 and communicating with the chain wheel room 434, and a flat wall 436 extending out from the bottom end of the opening 435.

The material feeding device 5 includes a moving base 51 placed on the two rails 421, a clamp head 53 formed in a front end of the moving base 51 for clamping a material pipe 30, and the moving base 51 moves forward and backward with the material pipe 30 along the material processing route 32. The material feeding device 5 is the same as the conventional pipe-bending machine, not to be described here.

The arm-fixing device 6 receives and positions the material pipe 30 being moved forward to prevent the rear portion of the bent portion of the material pipe under bending operation from protruding out.

The bending device 7 is positioned at the most front end of the extension table 43, to carry on bending work to the material pipe 30, having an arm-turning shaft 71 inserted in the flat wall 432, a bending mold 70 fixed around the arm-turning shaft 71 and possible to move together with the arm-turning shaft 71 or not if needed. The bending mold 70 has an annular groove 701 on an outer periphery for the material pipe 30 to fit in and contact with. The bottom end of the arm-turning shaft 71 is connected to the turning arm 72 by means of keys, and a clamp mold base 73 is fixed on the turning arm 72 and controlled by an oil pressure cylinder 74, possible to move forward to go near the bending mold 70. Further, a clamp mold 75 is provided in front of the clamp mold 73 having a clamp groove 751 facing the annular groove 701 of the bending mold 70 to commonly clamp the material pipe 30 together.

Figure 7:
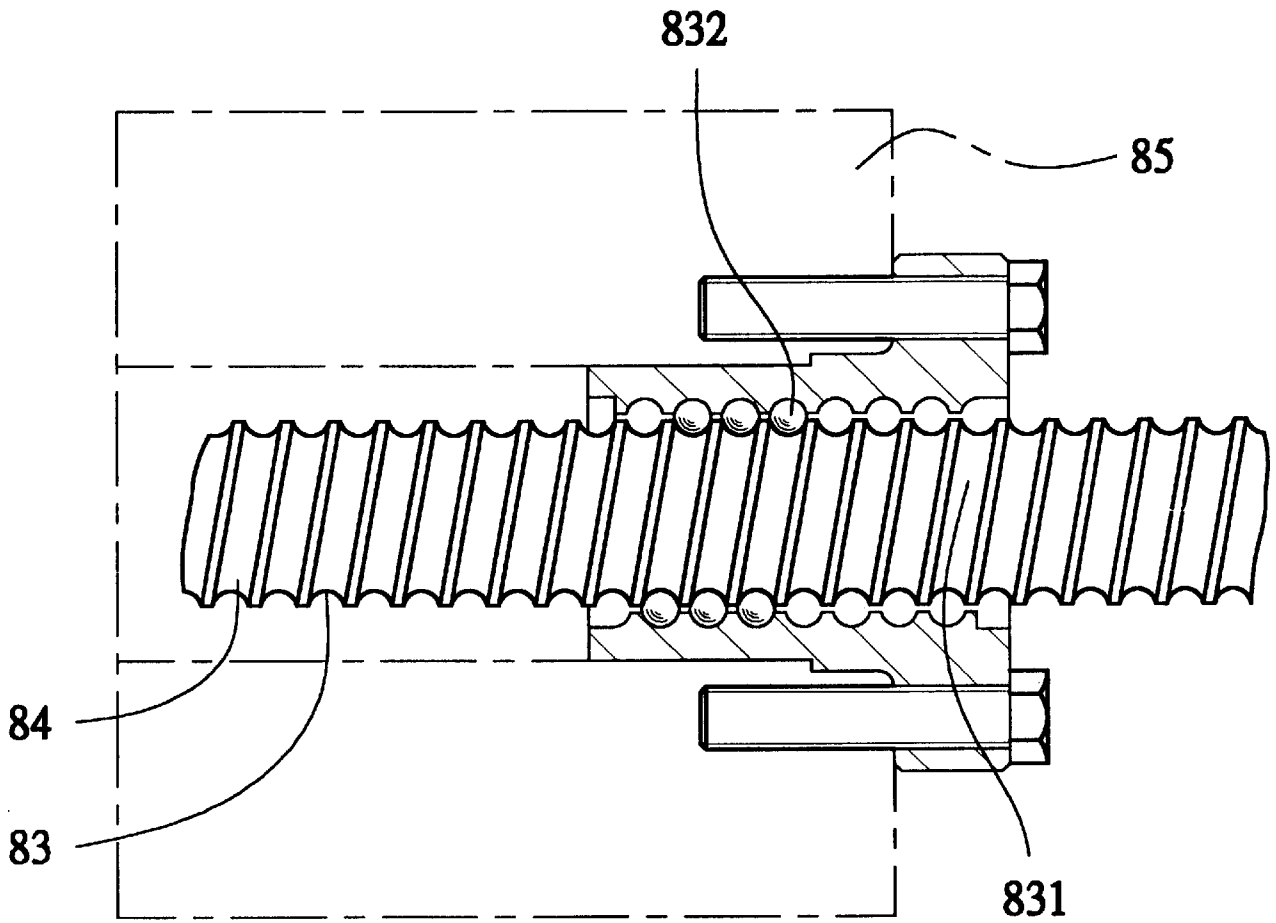
FIG. 7 is a cross-sectional view of a threaded rod, a threaded nut and a pull block combined together in the present invention; and, FIG. 8 is an upper view of bending a material pipe performed by the preferred embodiment of a pipe-bending machine in the present invention.

The transmitting device 8 shown in FIGS. 6 and 7 is positioned between the side wall 433 of the extension table 43 and the chain wheel room 434, having a motor fixing plate 81 vertically provided on the side wall 433 and located between the opening 435 and the basic wall 431, a bearing base 82 respectively fixed vertically at a front and a rear side of the opening 435. Further, a threaded rod 83 is fixed between the two bearing bases 82 in parallel to the side wall 433, having a spiral rail 831 formed on an outer annular surface, a threaded nut 84 fitted around the threaded rod 83. Between the inner wall of the threaded nut 84 and the spiral rail 831 are positioned plural balls 832, and the threaded nut 84 is firmly connected to a pull block 85. The pull block 85 has three lateral position grooves 851 on an end facing the chain room 434. A motor 86 is fixed on the motor fixing plate 81, having the axis of the motor 86 parallel to the threaded rod 83, and an output shaft 861 moving together with the threaded rod 83 by means of a belt device 87 to rotate the threaded rod 83. An interactive device 88 is provided between the pull block 85 and the arm-turning shaft 47.

The interactive device 88 includes three chain wheels 881 arranged vertically to engage with the arm-turning shaft 4, and three idle pulleys 882 positioned in the chain room 434 near the main table 41, and a chain 883 respectively extends between each idle pulley 882 and each chain wheel 881, passing through the position grooves 851 of the pull block 85 and secured with the pull block 85 by means of insert pins 884.

In order to avoid torque produced during the threaded rod 83 moving the pull block 85 forward to advance the chain 883, an interactive device 89 is provided at the bottom end of the threaded rod 83. The interactive device 89 has a slide rail 891 fixed on an inner side of the extension wall 436 and a slide block 892 fixed movable back and forth on the slide rail 891, and a fix plate 893 is connected between the two slide blocks 892 and the pull block 85.

Figure 8:
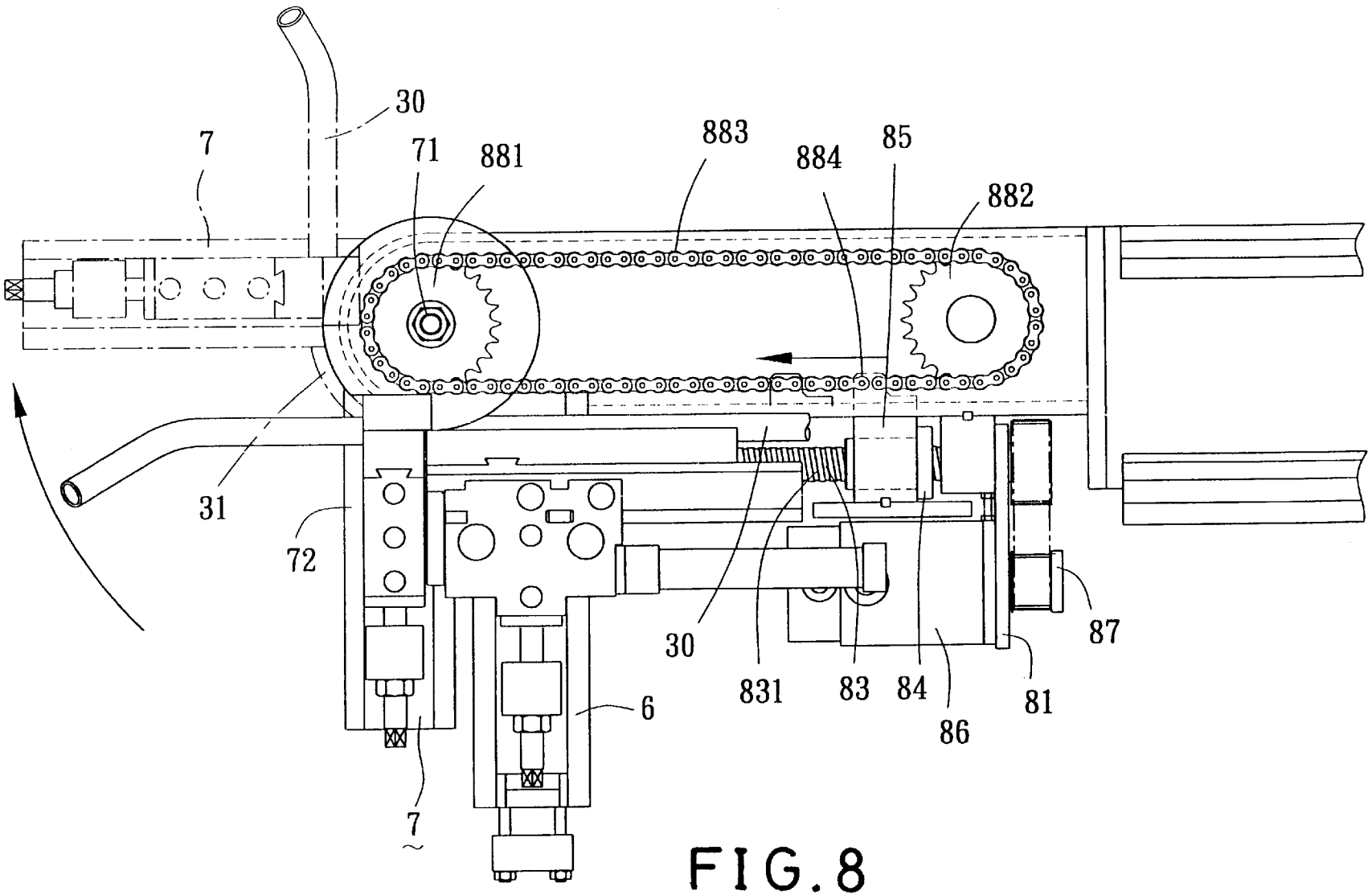

Next, as shown in FIGS. 4 and 8, when the pipe bending machine in the invention does not yet perform pipe bending action, the material pipe 30 is moving forward to the arm-turning shaft 71 by the feeding base 51, clamped by the clamp head 53 and the arm fixing device 6, stabilized on the base 4.

Now as shown in FIGS. 6, 7, and 8, in performing pipe-bending action, firstly a material pipe 30 is inserted in the feeding device 5, clamped by the clamp head 53, and then the arm fixing device 6 also clamps the material pipe 30. Then the motor 86 of the transmitting device 8 rotates the threaded rod 83 through the belt device 87, and at the same time, the threaded nut 84 moves forward on the spiral rail 831 of the threaded rod 83 by means of the balls 832. As the threaded nut 84 is firmly connected to the pull block 85, and the chain 883 is connected to the pull block 85, the rotation force of the threaded rod 83 obliges the pull block 85 move straightly to move the chain 883. Then the chain 883 moves to rotate the chain wheel 881 and then the arm-turning shaft 71. The turning arm 72 may rotate with the arm-turning shaft 71 as a pivot, as the arm-turning shaft 71 is connected to the turning arm 71 with keys. Then the material pipe 30 clamped between the bending groove 701 and the clamp groove 751 is bent to form the bent pipe 30. The arm fixing device 6 also moves forward during bending the material pipe 30, but operating principle of the arm fixing device 6 is not to be described here, as it is a well-known art.

It is worth to further explain that the embodiment in the invention has a speed reducer of common counter-pressure fixed on the output shaft 861 of the motor 86, in order to obtain low counter-pressure of the turning arm. As the embodiment has the threaded rod 83, the threaded nut 84 and the pull block 85 to convert rotating force into a straight movement. The threaded rod 83 has counter-pressure almost near zero, and the speed reducer is positioned before the ball threaded rod 83, counter-pressure of the turning arm 72 may be lowered in a great degree after changed by the threaded rod 83. So this design can permit the arm-turning shaft 71 have counter-pressure near zero, or reduce largely influence of counter-pressure of the speed reducer so as to achieve accurately controlling speed bending of pipes.

As can be understood by the above description, the pipe bending machine in the invention has accuracy in controlling high-speed rotating angle of the arm-turning shaft 71 to move the turning arm 71 accurately so as to accurately control bent angle of material pipes. In addition, the threaded rod 83 is fixed horizontal and the motor 86 is positioned low, so the height of the whole machine is lowered.

While the preferred embodiment of the invention has been described above, it will be recognized and understood that various modifications may be made therein and the appended claims are intended to cover all such modifications that may fall within the spirit and scope of the invention.

What is claimed is:

1. A pipe bending machine accurately controlling bent angle of pipes comprising:

a base;

a material feeding device;

an arm-fixing device;

a pipe bending device having one end provided with a arm-turning shaft fixed on a flat wall, said arm-turning shaft having a bending mold fixed around said arm turning shaft for a material pipe to rest on, and a turning arm connected to said art-turning shaft to move together, said turning arm having a clamp mold fixed thereon to clamp a material pipe together with said bending mold;

a transmitting device having a motor fixed on a side wall, a threaded rod rotated by said motor and located between two vertical bearing bases protruding up said side wall, a threaded nut fixed around said threaded rod, a pull block connected to said threaded nut to move together, and interactive device positioned between said pull block and the axis of said turning arm to transmit power;

said motor moving said threaded rod and also moving said pull block, said interactive device rotating said arm-turning shaft, said turning arm rotating with said arm-turning shaft as a center so as to perform bending accurately said material pipe clamped between said clamp mold and said arm-turning shaft.

2. The pipe bending machine accurately controlling bent angle of material pipes as claimed in claim 1, wherein said interacting device includes plural chain wheels located vertically and connected to said arm-turning shaft with keys, plural pulleys located under said flat wall and at the rear end of said threaded rod, a chain respectively extending around each said idle pulley and each said chain wheel to transmit power, said pull block having plural position grooves formed in an outer vertical side for said chains to fit therein and fixed firmly with said pull block with insert pins.

3. The pipe bending machine accurately controlling bent angle of material pips as claimed in claim 1, wherein said base has an extension horizontal wall extending outward from a bottom end of an opening formed in a side wall, a slide rail movably combined on said extension wall, more than one slide blocks combined on said slide rail, and said slide blocks connected to said pull blocks with a block fixing plate between to move together.

4. The pipe bending machine accurately controlling bent angle of material pips as claimed in claim 1, wherein said motor is fixed horizontally on a vertical motor fixing plate fixed to extend from a side vertical wall of said extension wall, located parallel to said threaded rod, said threaded rod rotated by a belt device combined with an output shaft of said motor.

* * * * *